US006877930B2

(12) United States Patent
Stromdahl et al.

(10) Patent No.: US 6,877,930 B2
(45) Date of Patent: Apr. 12, 2005

(54) METHOD OF WORKING A CONCRETE SURFACE

(75) Inventors: Carl Akesson Stromdahl, Enskada (SE); Conny Tangring, Saltsjö-Boo (SE)

(73) Assignee: Conjet AB, Haninge (SE)

( * ) Notice: Subject to any disclaimer, the term of this patent is extended or adjusted under 35 U.S.C. 154(b) by 109 days.

(21) Appl. No.: 10/362,119

(22) PCT Filed: Oct. 10, 2001

(86) PCT No.: PCT/SE01/02196

§ 371 (c)(1),
(2), (4) Date: Feb. 19, 2003

(87) PCT Pub. No.: WO02/31265

PCT Pub. Date: Apr. 18, 2002

(65) Prior Publication Data

US 2003/0164174 A1 Sep. 4, 2003

(30) Foreign Application Priority Data

Oct. 13, 2000 (SE) ..... 0003697

(51) Int. Cl.[7] ..... B26D 7/08
(52) U.S. Cl. ..... 404/75; 299/17; 83/22
(58) Field of Search ..... 404/72, 75, 94; 83/22, 177; 299/16, 17

(56) References Cited

U.S. PATENT DOCUMENTS 4,619,551 A 10/1986 Juan et al.
4,753,549 A * 6/1988 Shook et al. ..... 404/75
4,761,037 A * 8/1988 Medeot ..... 299/1.5
4,793,734 A * 12/1988 Shook et al. ..... 404/90
4,854,770 A * 8/1989 Puchala et al. ..... 404/75
5,361,993 A * 11/1994 Andersson ..... 239/752
6,179,519 B1 * 1/2001 Hilmersson ..... 404/91
6,224,162 B1 * 5/2001 MacNeil et al. ..... 299/17
6,435,620 B2 * 8/2002 MacNeil et al. ..... 299/17

FOREIGN PATENT DOCUMENTS

WO 9815690 4/1998

* cited by examiner

*Primary Examiner*—Gary S. Hartmann
(74) *Attorney, Agent, or Firm*—Mark P. Stone

(57) ABSTRACT

A method for working a concrete surface uses a water jet ejected from a nozzle of a nozzle holder. The nozzle holder reciprocates in cutting sweeps and moves together with a working apparatus in steps between the cutting sweeps. The water jet is directed in directions of the sweeps, and at the end of each sweep, the nozzle holder is swung into a new angle of attack for a subsequent cutting sweep. At the end of a cutting sweep, the nozzle holder begins to swing backwards simultaneously as its linear velocity increases to permit the target area to remain substantially unchanged at the start of the stepping of the working apparatus so that the water jet makes a cut forwardly in the stepping direction. The stepping and change of angle of attack are completed simultaneously immediately prior to the commencement of a subsequent cutting sweep.

8 Claims, 4 Drawing Sheets

METHOD OF WORKING A CONCRETE SURFACE

TECHNICAL FIELD OF THE INVENTION

This invention relates to a method of working a concrete surface by a water jet by using a machine that comprises a water jet nozzle at the end of an elongated nozzle holder carried by a trolley that is movable to and fro along a guide. The holder with its nozzle is moved in working sweeps with the nozzle in an attacking angle, and at the end of a sweep, the holder is swung into a position in which the nozzle will have an attacking angle during the subsequent sweep, and the guide with the trolley and the holder is stepped forward between the sweeps.

BACKGROUND TECHNIQUE

Road salting influences concrete and the surface layer for example on concrete bridges must be renewed after a number of years before the road salt has reached the reinforcement. The maintenance costs will be high if the salt already has had an effect on the reinforcement. Therefore, one wants to remove the surface layer and free the uppermost layer of reinforcement before the reinforcement has been influenced and then replace it with a new surface layer. Machines for such concrete removal are known from SE-451742-B, U.S. Pat. No. 5,361,993-A and SE 508821-C.

U.S. Pat. No. 5,361,993-A shows and describes a machine that is to be used in the way described above. The elongated nozzle holder is carried by a trolley that rolls on a guide. When the trolley reaches its end position, it remains there and the entire machine is stepped forwards so that the guide for the trolley is moved forwards. The trolley is still not moving while the nozzle holder is swung in order to provide an attack angle for the subsequent sweep. When the holder with its nozzle has reached its predefined angle, the trolley begins its movement. The nozzle moves with the same speed during its swinging movement as during the movement of the trolley.

OBJECT OF INVENTION AND BRIEF DESCRIPTION OF AN EXAMPLE OF THE INVENTION

It is an object of the invention to provide a more uniform cutting at the edges than can be reached by prior art technique. To this end, when the water jet reaches its end position, the holder is swung to give the nozzle its attacking angle in the subsequent step while the carrier continues its movement towards its position of turning. The invention has been given the characteristics defined in the claims.

It is advantageous to step forward the holder (30) while it is being swung to its new attacking angle. It is then also advantageous to adapt the swing velocity of the holder to its linear movement so that the water jet makes a cut (34) in the direction of stepping. It is particularly advantageous to begin and end the stepping and the swinging of the holder simultaneously.

DESCRIPTION OF THE BEST MODES FOR CARRYING OUT THE INVENTION

Figure 1:
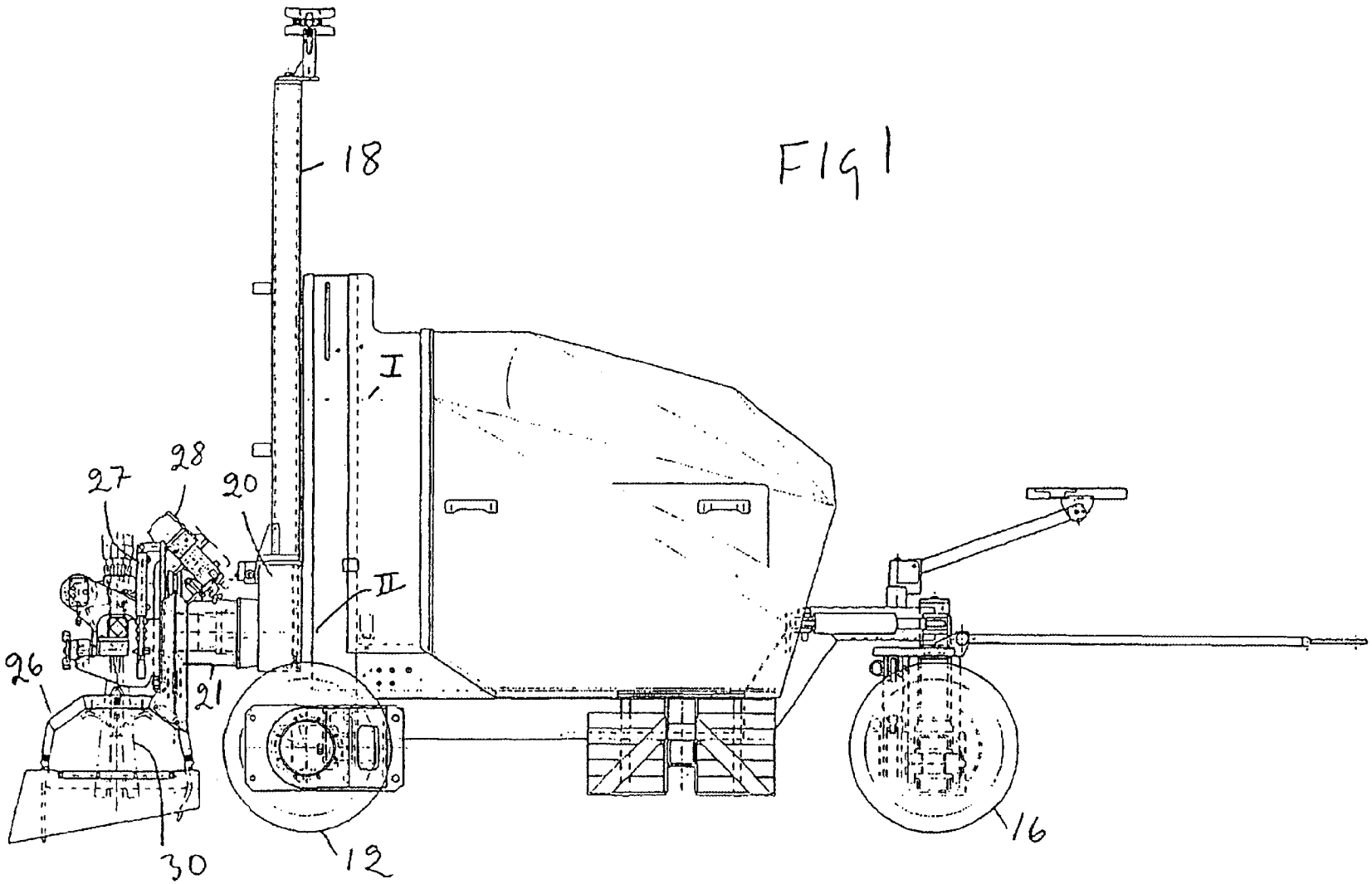
FIG. 1 is a side view of a machine by which the method according to the invention can be carried out.
Figure 2:
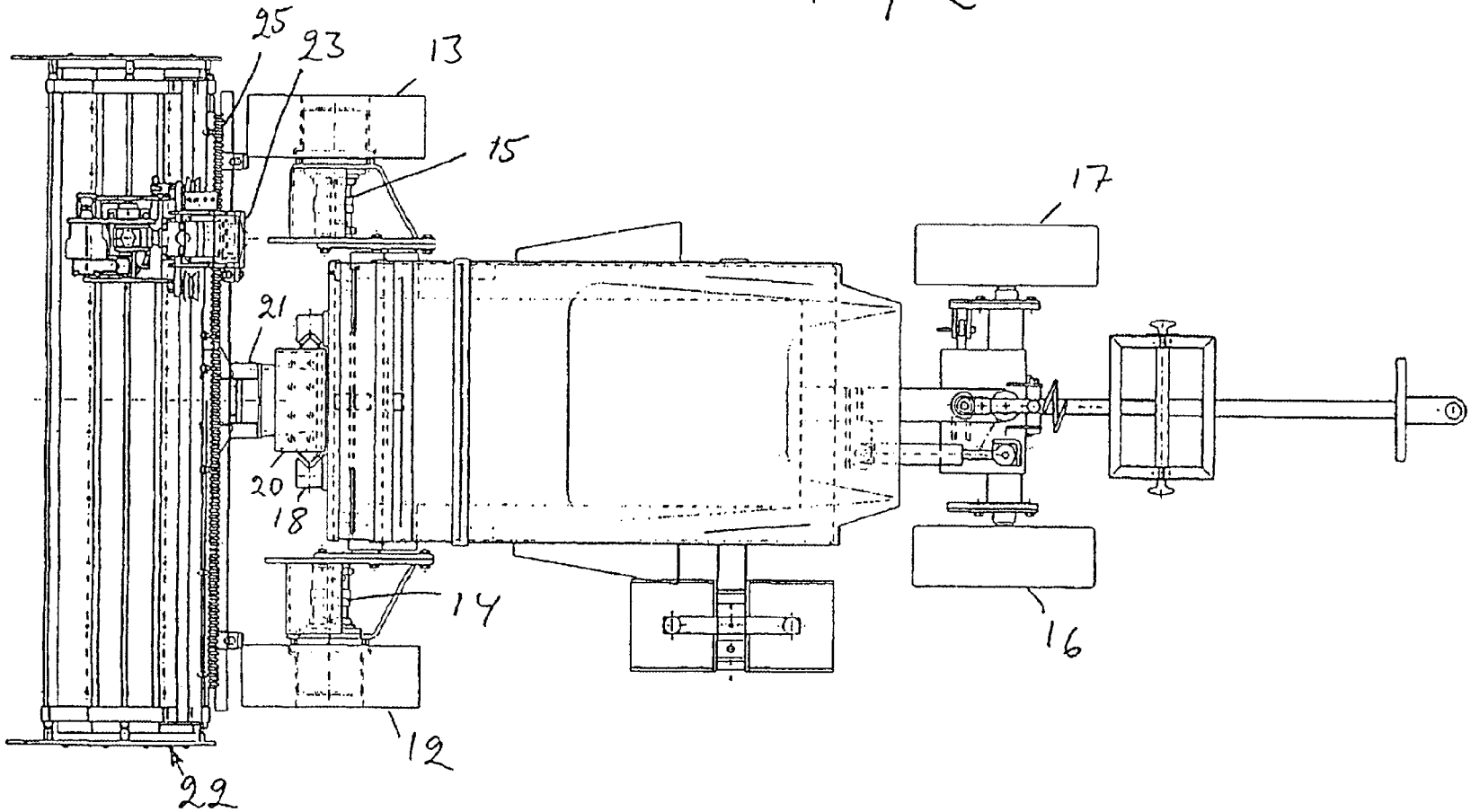
FIG. 2 is a top elevation view of the machine.
Figure 3:
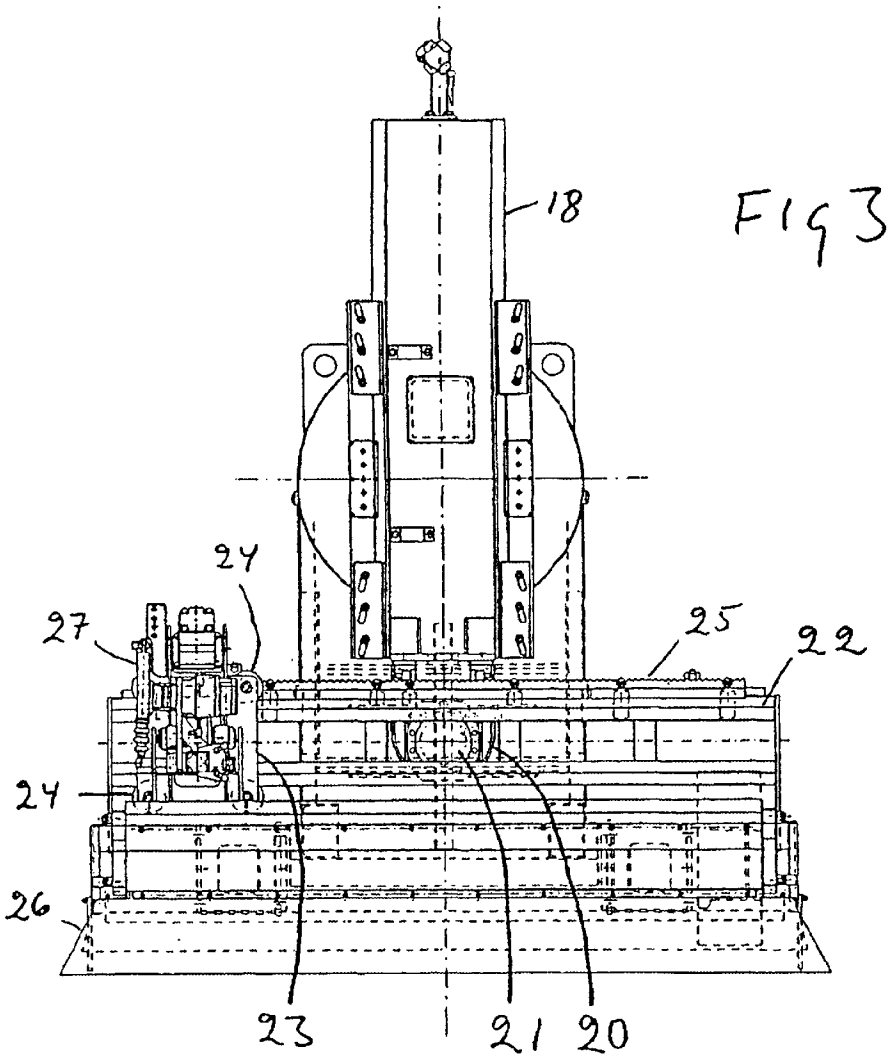

The machine shown in the FIGS. 1–3 has two front wheels 12, 13 with built-in motors 14, 15 and it is steerable by its rear wheels 16, 17. The machine has a pillar 18 that is rotatable about an axis I and makes a guide for a carrier 20. The carrier 20 carries a mount 21 for a feed beam or guide 22 that is at right angle to an axis II about which the feed beam can be rotated. This arrangement provides a great freedom in the positioning of the feed beam.

The feed beam 22 carries a trolley 23 with four wheels 24, and the trolley 23 has a built-in motor with pinions meshing with a rack 25 on the feed beam. The trolley 23 carries a holder 30 for a water jet nozzle 31 inside a protective shield 26. The holder 30 is swingable in the plane of the paper in FIG. 3 by means of a hydraulic cylinder 27 in order to provide for a suitable attacking angle of the nozzle both when the carrier moves to the right and to the left in FIG. 3 as will be described with reference to the FIGS. 4–9. In addition, a motor 28 is arranged to oscillate the holder 30 in the plane of the paper in FIG. 1, and the central position of the holder as well as its end positions are indicated in FIG. 1.

Figure 4:
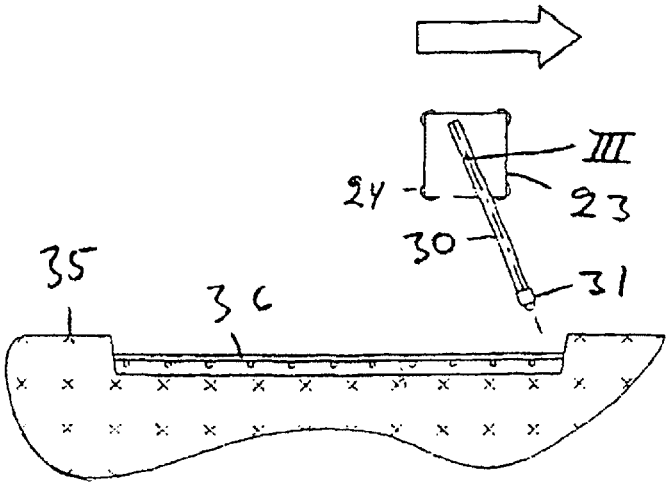
FIGS. 4, 6 and 8 show schematically and in section a concrete roadway, the surface of which is cut by the machine shown in FIG. 1, only a few parts of the machine being shown.

FIG. 4 shows a concrete track, for example a roadway 35 on a bridge, the surface of which is being cut by means of the machine shown in FIGS. 1–3. Only the trolley 23 with its wheels and the elongated nozzle holder 30 with its nozzle 31 are shown in the figure. The holder is swingable about an axis III. The roadway is shown in section in FIGS. 4, 6 and 8 while being worked.

A preferred cycle of working will now be described with reference to the FIGS. 4–9.

Figure 6:
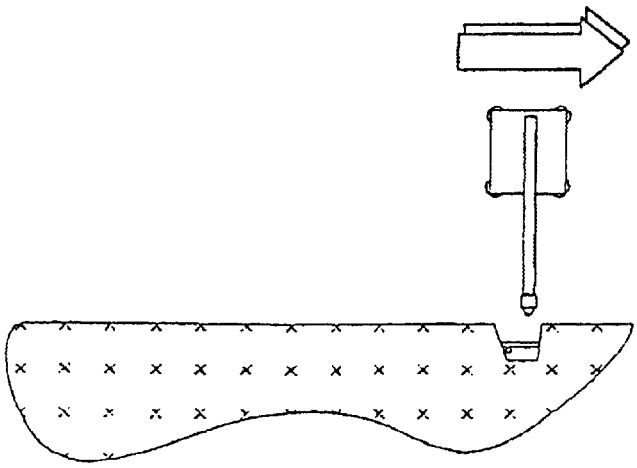

The trolley 23 is shown in FIG. 4 in its movement to the right in the figure as indicated by the arrow. During that working sweep, the nozzle holder has had an attacking angle as shown in the figure and the water jet out of the nozzle 31 has cut away the surface layer of the concrete so that the uppermost layer of reinforcement 36 has been freed. When the trolley reaches its position shown, the nozzle holder begins-to swing over to its attacking angle it will have during the subsequent working sweep to the left in the figure. At the same time, the trolley increases its speed to the right in the figure so that the nozzle will remain in about the same position as shown in FIG. 6 until the nozzle holder 30 reaches its new angle of attack. During this movement, the whole machine is stepped forward (out of the paper) by means of the motors 14, 15 of the front wheels 12, 13 and the water jet will then make a cut 34 forwards as shown in FIG. 6.

Figure 5:
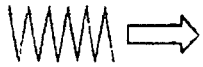
FIGS. 5, 7 and 9 show the respective pattern of movement of a water nozzle shown in FIGS. 4, 6 and 8.

Since the nozzle holder all the time is oscillated transverse to the movement of the trolley 23 in a frequency that is high as compared to the movement of the trolley, the target area of the water jet will have the path shown in FIG. 5. Suitably, in practice, the oscillation is faster in relation to the speed of the trolley 23 than shown in FIG. 5. The trolley can for example move in a velocity of 5–10 m/s during the sweep shown in figure 4 and for example in doubled velocity during the final phase shown in FIG. 6 whereas the oscillation frequency can for example be 40–400 double strokes per minute. The oscillation makes the cut track wide although the water jet is narrow.

Figure 7:
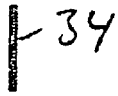
Figure 8:
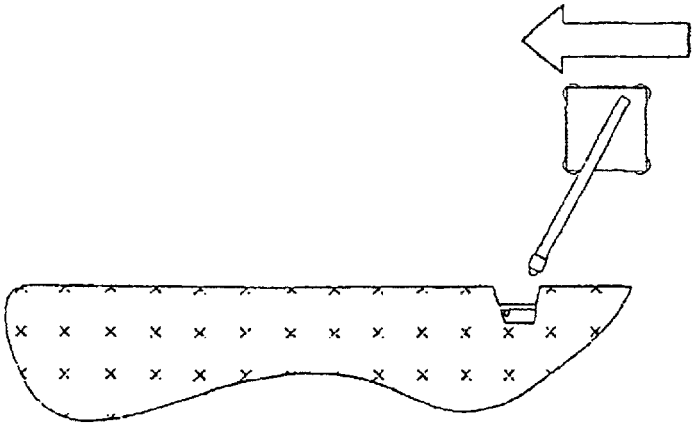
Figure 9:
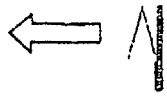

FIG. 7 shows the target track of the water jet until the new angle of attack is reached. Then, the trolley 23 turns and begins its cutting sweep to the left in FIG. 8. FIG. 9 shows the track of the target area of the water jet until the cutting to the left in the figure has begun in the cutting sweep to the left. The turning at the end of this cutting sweep to the left is carried out in the same way as the described turning at the end of a cutting sweep to the right. The water jet can be continuous during the entire process.

By adapting to each other the velocity of the trolley 23 and the swing velocity of the nozzle holder 30 during the change of attack angle, one can get a cutting at the end of the cutting sweeps that corresponds to the cutting during the major part of the cutting sweeps. Otherwise, there can be bumps and pits near the sides of the cutting area. It is also advantageous to make the steps during the change of angle of attack as described. One can easily make changes in any one of the parameters during the cutting until the best result is reached. Suitably, the stepping and the change of angle of attack should start and finish simultaneously. A suitable angle of attack can be freely chosen without affecting the cutting close to the sides of the cutting area.

What is claimed is:

1. A method of working a concrete surface with a water jet, said method comprising the steps of:

providing a trolley (23) carrying a nozzle holder (30) having a water jet nozzle (31) at an end of the nozzle holder;

moving the trolley (23) to and fro along a guide between turning positions, and moving the nozzle holder and water jet nozzle in working sweeps with the water jet nozzle in a predetermined angle of attack;

swinging the nozzle holder into a position to provide the water jet nozzle with an angle of attack that it will maintain in the next subsequent sweep at the end of a preceding sweep while the trolley continues to move, and stepping forward the guide with the trolley and the nozzle holder between sweeps; and continuing to move the trolley along said guide towards a turning position at the end of a sweep as the water jet reaches an end position of said sweep at the same time during which said nozzle holder is swung into said position in which said water jet nozzle assumes the angle of attack it will maintain during the subsequent sweep.

2. The method as claimed in claim 1, further including the step of:

stepping forward the nozzle holder the same time during which said nozzle holder is swung into the angle of attack it will assume in said subsequent sweep.

3. The method as claimed in claim 2, further including the step of:

coordinating the swing velocity of the nozzle holder (30) and the linear movement of the trolley (23), so as to cause the water jet to make a cut (34) in said concrete surface in a direction of said stepping of said nozzle holder.

4. The method as claimed in claim 3, further including the step of:

terminating the stepping and swinging of said nozzle holder at the same time.

5. The method as claimed in claim 1, further including the step of:

increasing the linear velocity of the trolley when the water jet reaches its end position, and maintaining the increased linear velocity of said trolley until the nozzle holder is swung into the angle of attack it will maintain during the subsequent sweep.

6. The method as claimed in claim 2, further including the step of:

increasing the linear velocity of the trolley when the water jet reaches its end position, and maintaining the increased linear velocity of said trolley until the nozzle holder is swung into the angle of attack it will maintain during the subsequent sweep.

7. The method as claimed in claim 3, further including the step of:

increasing the linear velocity of the trolley when the water jet reaches its end position, and maintaining the increased linear velocity of said trolley until the nozzle holder is swung into the angle of attack it will maintain during the subsequent sweep.

8. The method as claimed in claim 4, further including the step of:

increasing the linear velocity of the trolley when the water jet reaches its end position, and maintaining the increased linear velocity of said trolley until the nozzle holder is swung into the angle of attack it will maintain during the subsequent sweep.

* * * * *